United States Patent [19]

Makino et al.

[11] Patent Number: 4,670,343

[45] Date of Patent: Jun. 2, 1987

[54] WHOLLY AROMATIC POLYAMIDE FIBER

[75] Inventors: Shoji Makino; Michikage Matsui, both of Ibaraki; Shozaburo Hiratsuka, Iwakuni, all of Japan

[73] Assignee: Teijin Limited, Osaka, Japan

[21] Appl. No.: 724,922

[22] Filed: Apr. 19, 1985

[30] Foreign Application Priority Data

Apr. 26, 1984 [JP] Japan ..... 59-82866

[51] Int. Cl.[4] ..... D02G 3/00

[52] U.S. Cl. ..... 428/395; 428/372; 428/375; 428/373; 428/364; 57/902

[58] Field of Search ..... 428/372, 375, 395, 364, 428/373; 57/243, 902

[56] References Cited

U.S. PATENT DOCUMENTS

| | | | |
|---|---|---|---|
| 3,503,880 | 3/1970 | McMicken | 428/395 X |
| 3,850,682 | 11/1974 | Sturwold et al. | 428/395 |
| 4,337,155 | 6/1982 | Sasaki et al. | 428/395 X |
| 4,455,341 | 6/1984 | Harteman | 428/395 X |

*Primary Examiner*—Lorraine T. Kendell

*Attorney, Agent, or Firm*—Kenyon & Kenyon

[57] ABSTRACT

Surface frictional characteristics of a wholly aromatic polyamide fiber are desirably modified by applying to the fiber at least 0.05% by weight, based on the fiber, of a reaction product of a polyoxyethylene adduct of glyceride having at least one hydroxyl group in the molecule with a dibasic acid and/or a dibasic anhydride. Preferably, prior to the application of the reaction product, at least 0.01% by weight of an inorganic compound powder is applied to the fiber.

18 Claims, No Drawings

WHOLLY AROMATIC POLYAMIDE FIBER

BACKGROUND OF THE INVENTION

1. Field of the Invention

The present invention relates to a wholly aromatic polyamide fiber having improved surface frictional characteristics.

More particularly, it relates to a wholly aromatic fiber which exhibits a reduced filament-to-filament friction coefficient under a high contact pressure, is almost completely neither broken nor fibrillated at the twisting step, and has excellent fiber qualities such as a high strength of a twisted cord.

2. Description of the Related Art

In order to meet recent demands for increasing the strength and modulus of fibers, various novel fiber-forming materials have been proposed.

However, most of these fibers have a high rigidity and a hard touch, and fibrillation is readily caused by friction among filaments. Consequently, fluffing or filament breaking is readily caused. These defects result in degradation of such characteristics as strength and modulus.

As means for obtaining a fiber having high strength and modulus, a method has been adopted in which drawing is carried out at a high draw ratio under high temperature conditions. In this method, however, fusion bonding is readily caused among individual fibers of a fiber bundle. As means for preventing this fusion bonding among fibers, a method has been proposed in which fine particles of an inorganic substance are applied to an undrawn yarn in advance (see Japanese Unexamined Patent Publication No. 58-54021, No. 53-147811 and No. 54-15020).

However, a fiber to whose surface an inorganic substance has been applied in the form of fine particles or a coating film exhibits increased frictional characteristics. Accordingly, if these fibers are used in the form of twisted yarns, for example, as rubber reinforcement for tires, belts, and hoses, or if several multifilaments are twisted for production of ropes, fishing lines, and the like, the high strength, which is a high-performance characteristic inherently possessed by the fiber, is not sufficiently utilized in the resulting twisted cord.

SUMMARY OF THE INVENTION

It is a primary object of the present invention to solve the foregoing problems in the conventional techniques and, more specifically, to provide a wholly aromatic polyamide fiber which exhibits a reduced filament-to-filament frictional coefficient under a high contact pressure and which shows a high strength retention ratio after the twisting operation in fields where the fiber is used after the twisting operation, for example, as a reinforcing cord for a rubber or composite material.

In accordance with the present invention, there is provided a wholly aromatic polyamide fiber having applied thereto at least 0.5% by weight, based on the fiber, of a reaction product of a polyoxyethylene adduct of glyceride having at least one hydroxyl group in the molecule with a dibasic acid and/or a dibasic anhydride.

DESCRIPTION OF THE PREFERRED EMBODIMENTS

By the wholly aromatic polyamide fiber referred to herein is meant a fiber composed of an aromatic homopolyamide or copolyamide in which at least 80% by mole, preferably at least 90% by mole of the polyamide-constituting recurring units are represented by the following formula:

$$-NH-Ar_1-NHCO-Ar_2-CO-$$

wherein $Ar_1$ and $Ar_2$, which may be the same or different, are an aromatic residue selected from

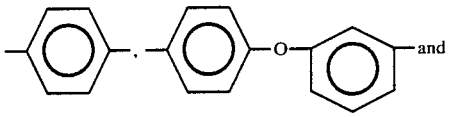

and

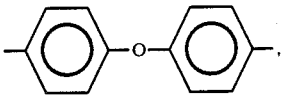

with the proviso that hydrogen atoms of the aromatic residue may be substituted with halogen atoms and/or lower alkyl groups.

Processes for the preparation of these wholly aromatic polyamides are disclosed in, for example, British Patent No. 1,501,948, U.S. Pat. No. 3,738,964, and Japanese Unexamined Patent Publication No. 49-100322.

Among the foregoing wholly aromatic polyamides, an aromatic copolyamide in which at least 80% by mole of $Ar_1$ and $Ar_2$ are aromatic residues (A) and (B) represented by the following formulae:

(A)

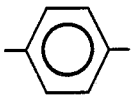

and (B)

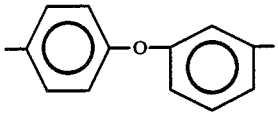

wherein hydrogen atoms of these aromatic residues may be substituted with halogen atoms and/or lower alkyl groups, and the content of the structural units (B) is 10 to 40% by mole is especially preferred. An example of this preferred aromatic copolyamide is a copolyamide consisting of 10% to 40% by mole of

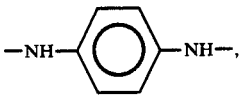

10% to 40% by mole of

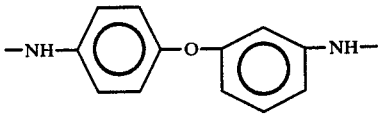

mole of

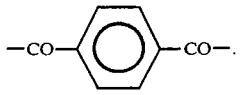

Furthermore, an aromatic polyamide in which at least 30% by mole of $Ar_1$ and $Ar_2$ are aromatic residues (A) and (B') represented by the following formulae:

(A)

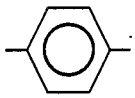

and (B')

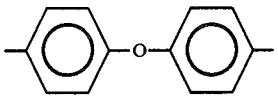

wherein hydrogen atoms of these aromatic residues may be substituted with halogen atoms and/or lower alkyl groups, and the content of the structural units (B') is 10% to 40% by mole also is preferred. An example of this aromatic polyamide is a copolyamide consisting of 10% to 40% by mole of

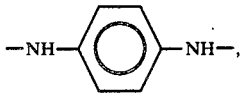

10% to 40% by mole of

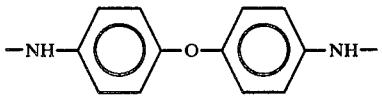

and 50% by mole of

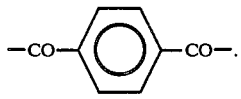

As the glyceride having at least one hydroxyl group in the molecule, a triglyceride is most preferable. A typical instance of the triglyceride is castor oil composed mainly of a triglyceride of ricinoleic acid. Namely, it is preferable that, for example, a polyethylene oxide adduct of hardened castor oil be used as a frictional characteristic modifying agent for a wholly aromatic polyamide fiber.

The number of ethylene oxide in the polyoxyethylene adduct is from 5 to 50 moles, preferably 10 to 30 moles.

As the dibasic acid and/or dibasic acid anhydride, there can be mentioned dibasic acids such as succinic acid, adipic acid, sebacic acid and thiodipropionic acid and/or anhydrides thereof.

A terminal blocking agent, for example, a higher fatty acid such as oleic acid, stearic acid or behenic acid may be used for the reaction of the polyoxyethylene adduct of the glyceride with the dibasic acid and/or the dibasic acid anhydride.

A reaction product obtained by the reaction of the polyoxyethylene oxide adduct of the triglyceride with the dibasic acid and/or the dibasic acid anhydride is a high polymeric substance having a bulky structure. Accordingly, if this high polymeric substance is applied to the surface of the wholly aromatic polyamide fiber and especially when filaments are frictionally contacted with one another under a high contact pressure, contact in the solid state is prevented and the lubrication among filaments is improved.

The reaction product has a viscosity of at least 500 cps, preferably, 1,000 to 5,000 cps, as measured at 30° C. by using a Cannon-Fenske viscometer. If the viscosity is below 500 cps, the intended frictional characteristic-improving effect is not attained. If the viscosity is too high, the reaction product is difficult to handle. The reaction product is usually difficult to apply alone to the surface of the fiber because of its high viscosity. Accordingly, the reaction product is used in combination with an oil composition comprising a lubricant, an antistatic agent and other surface active agents, such as a fiber treating agent customarily used in the art. A suitable amount of the oiling composition can be applied to the surface of the fiber through an oiling roller or metering nozzle or by spraying.

The reaction product is applied to the fiber in an amount, as the pure reaction product, of 0.05% to 2% by weight, preferably 0.1% to 1% by weight, based on the fiber. If the amount of the reaction product is smaller than 0.05% by weight, no substantial friction-modifying effect is attained. If the amount of the reaction product exceeds 2% by weight, the friction-modifying effect is low. Also, contamination is caused because of deposition of the reaction product on a yarn guide or roller during travel of the yarn, and therefore, the productivity is reduced. Accordingly, use of too large an amount of the reaction product is not advantageous from the industrial viewpoint.

In the present invention, it is preferable that a powder of an inorganic compound be applied to the surface of the wholly aromatic polyamide fiber in an amount of at least 0.01% by weight based on the fiber.

The powder of the inorganic compound is applied for preventing heat fusion bonding among fibers caused when the wholly aromatic polyamide fiber is heat-drawn and/or heat-treated at a high temperature. The inorganic compound includes, for example, talc, graphite, silica and hydrous aluminum silicate. The larger the amount of the powder of the inorganic compound applied to the fiber surface, the more prominent the intended effect of the present invention. If the amount of the inorganic compound applied to the fiber surface is smaller than 0.01% by weight based on the fiber, the effect of preventing fusion bonding among filaments cannot be attained.

The wholly aromatic polyamide fiber of the present invention has a greatly reduced frictional coefficient among fibers under a high pressure. Hence, when the wholly aromatic fiber is used for a tire cord, reduction of the strength by false twisting texturing can be minimized and a twisted yarn cord of a wholly aromatic polyamide fiber having a desirable strength can be obtained.

The present invention will now be described in detail with reference to the following examples. In the examples, the fiber strength and cord strength were evaluated according to the following methods.

(1) Strength of Fiber

A load-elongation curve of a fiber sample was determined in an atmosphere maintained at a temperature of 20° C. and a relative humidity of 65% at a pulling speed of 10 cm/min with an initial sample length of 25 cm by using an Instron tester. The strength (g/d) was obtained from this curve.

(2) Strength of Cord

A double-twisted cord having single twist and folded twist of 40 turns per 10 cm was tested in the same manner as described in (1) above by using an Instron tester to obtain a strength (g/d).

EXAMPLES 1 THROUGH 3 AND COMPARATIVE EXAMPLES 1 AND 2

A wholly aromatic copolyamide consisting of 25% by mole of p-phenylene-diamine, 50% by mole of terephthaloyl chloride and 25% by mole of 3,4'-diaminodiphenyl ether was dissolved at a concentration of 6% by weight in N-methyl-2-pyrrolidone (NMP) containing calcium chloride. The polymer solution was extruded from a spinneret having 1000 holes, coagulated in an aqueous 30% by weight solution of NMP and washed with water. Then, the spun fiber was immersed for 4 seconds in an aqueous dispersion of a powdery mixture containing talc and hydrous aluminum silicate at a ratio of 8/2, dried and drawn at 500° C. at a drawn ratio of about 10. Then, an oiling agent emulsion comprising an ordinary fiber treating agent composed mainly of dioleyl adipate, in which a reaction product (a polymeric substance) of a polyethylene oxide-added hardened castor oil with maleic anhydride, which was formed by using stearic acid as the terminal blocking agent, was incorporated in an amount shown in Table 1, was applied to the drawn yarn by passing the yarn over a roller applicator that is partially submerged in a reservoir of the emulsion. The yarn was wound at a speed of 400 m/min to obtain a drawn yarn having a fineness of 1500 denier. The amounts applied of the inorganic compound power and the oiling agent were 0.5% by weight and 2% by weight, respectively, based on the yarn weight.

A greige cord was prepared by giving single twist and folded twist of 40 turns per 10 cm to the obtained fiber and the strength of the twisted yarn cord was measured. The strength of the fiber and the strength of the cord were as shown in Table 1.

TABLE 1

| | Oiling agent/ polymeric substance* | Amount of polymeric substance as pure product (%) | Strength of fiber (g/d) | Strength of cord (g/d) | Strength retention ratio (%) |
|---|---|---|---|---|---|
| Comparative Example 1 | 100/0 | 0 | 25.3 | 12.6 | 50 |
| Comparative Example 2 | 100/1 | 0.02 | 25.4 | 13.2 | 52 |
| Example 1 | 100/10 | 0.2 | 25.2 | 17.1 | 68 |
| Example 2 | 100/20 | 0.4 | 25.6 | 18.4 | 72 |
| Example 3 | 100/100 | 1.0 | 25.5 | 17.6 | 71 |

Note
*Reaction product of ethylene oxide-added hardened castor oil with maleic anhydride formed by using stearic acid as the terminal blocking agent

EXAMPLE 4

The experiment was carried out in the same manner as described in Example 1 except that a reaction product of ethylene oxide-added castor oil with adipic acid was used as the polymeric substance and this polymeric substance was incorporated in an amount of 20 parts by weight into 100 parts by weight of the oiling agent used in Example 1. The strength of the obtained fiber was 24.8 g/d and the strength of the cord was 17.3 g/d.

We claim:

1. A wholly aromatic polyamide fiber having improved surface frictional characteristics, CHARACTERIZED having applied thereto 0.05 to 2.0% by weight, based on the fiber, of a reaction product of a polyoxyethylene adduct of a glyceride having at least one hydroxyl group in the molecule with at least one compound selected from a dibasic acid and a dibasic anhydride.

2. A wholly aromatic polyamide fiber according to claim 1, which is composed of an aromatic homopolyamide or copolyamide in which at least 80% by mole of the polyamide-constituting recurring units are represented by the following formula:

$$-NH-Ar_1-NHCO-Ar_2-CO-$$

wherein $Ar_1$ and $Ar_2$, which may be the same or different, are an aromatic residue selected from

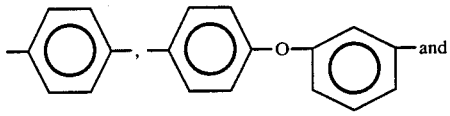

and

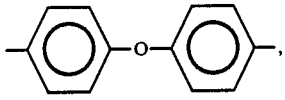

with the proviso that hydrogen atoms of the aromatic residue may be substituted with at least one member selected from halogen atoms and lower alkyl groups.

3. A wholly aromatic polyamide fiber according to claim 2, which is composed of an aromatic copolyamide in which at least 80% by mole of the total of $Ar_1$ and $Ar_2$ are aromatic residues (A) and (B) represented by the following formulae:

(A)

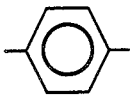

-continued (B)

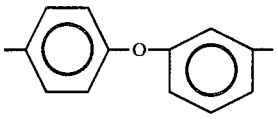

wherein hydrogen atoms of these aromatic residues may be substituted with at least one member selected from halogen atoms and lower alkyl groups, and the content of the residue (B) is 10% to 40% by mole.

4. A wholly aromatic polyamide fiber according to claim 3, wherein the aromatic copolyamide consists of 10% to 40% by mole of

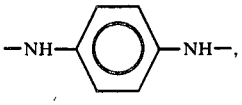

10% to 40% by mole of

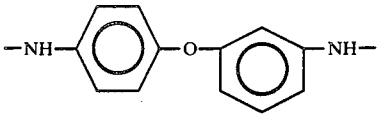

and 50% by mole of

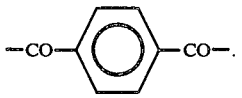

5. A wholly aromatic polyamide fiber according to claim 2, which is composed of an aromatic copolyamide in which at least 30% by mole of the total of $Ar_1$ and $Ar_2$ are aromatic residues (A) and (B') represented by the following formulae:

(A)

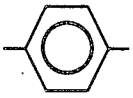

and (B')

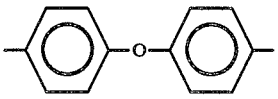

wherein hydrogen atoms of these aromatic residues may be substituted with at least one member selected from halogen atoms and lower alkyl groups, and the content of the residue (B') is 10% to 40% by mole.

6. A wholly aromatic polyamide fiber according to claim 5, wherein the aromatic copolyamide consists of 10% to 40% by mole of

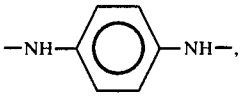

10% to 40% by mole of

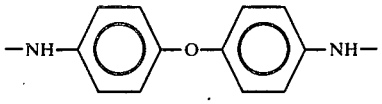

and 50% by mole of

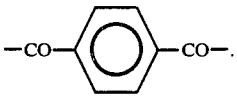

7. A wholly aromatic polyamide fiber according to claim 1, wherein the glyceride is a triglyceride.

8. A wholly aromatic polyamide fiber according to claim 1, wherein the mole number of ethylene oxide in the polyoxyethylene adduct is from 5 to 50.

9. A wholly aromatic polyamide fiber according to claim 1, wherein the reaction product of a polyoxyethylene adduct of the glyceride has a molecular weight of at least 2,000.

10. A wholly aromatic polyamide fiber according to claim 1, wherein the amount of the reaction product applied is from 0.05% to 2% by weight as the pure reaction product based on the fiber.

11. A wholly aromatic polyamide fiber according to claim 1, wherein the polyamide fiber, to which said reaction product is applied, has applied thereto at least 0.01% by weight, based on the fiber, of an inorganic compound powder.

12. A reinforcing cord having a reduced filament-to-filament friction coefficient under high contact pressures comprising a plurality of wholly aromatic polyamide filaments having thereon 0.05 to 2.0% by weight of a reaction product of a polyoxyethylene adduct of a glyceride having at least one hydroxyl with at least one acidic compound selected from the group consisting of a dibasic acid and a dibasic anhydride applied thereto; and said reaction product has a viscosity greater than 500 cps.

13. The reinforcing cord set forth in claim 12 wherein the wholly aromatic polyamide is a homopolyamide or copolyamide in which at least 80 mole percent of the polyamide constitutes recurring units represented by the following formula:

—NH—$Ar_1$—NHCO—$Ar_2$—CO— wherein $Ar_1$ and $Ar_2$, which may be the same or different, are an aromatic residue selected from

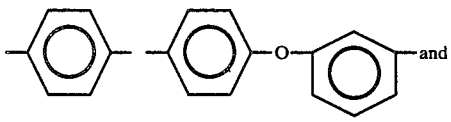

-continued

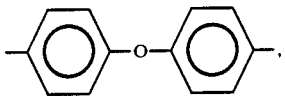

with the proviso that hydrogen atoms of the aromatic residue may be substituted with at least one member selected from atoms and lower alkyl groups.

14. The reinforcing cord set forth in claim 13 wherein the wholly aromatic polyamide is a copolyamide in which at least 80% mole percent of the total $Ar_1$ and $Ar_2$ are aromatic residues (A) and (B) represented by the following formulae:

(A)

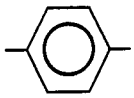

and (B)

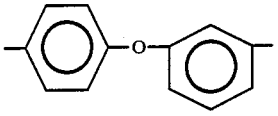

wherein hydrogen atoms of these aromatic residues may be substituted with at least one member selected from halogen atoms and lower alkyl groups, and the content of the residue (B) is 10 to 40 mole percent.

15. The reinforcing cord set forth in claim 14 wherein the aromatic copolyamide consists of 10% to 40% by mole of —NH—NH—, 10 to 40 mole percent of

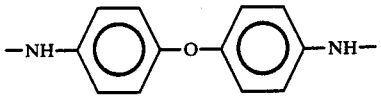

and 50 mole percent of

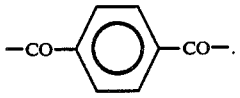

16. The fiber set forth in claim 13 wherein the aromatic polyamide is a copolyamide in which at least 30 mole percent of the total $Ar_1$ and $Ar_2$ are aromatic residues (A) and (B') represented by the following formulae:

(A)

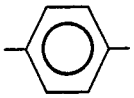

and (B')

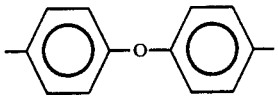

wherein hydrogen atoms of these aromatic residues may be substituted with at least one member selected from halogen atoms and lower alkyl groups, and the content of the residue (B) is 10 to 40 mole percent.

17. The reinforcing cord set forth in claim 15 wherein the aromatic copolyamide consists of 10 to 40 mole percent of

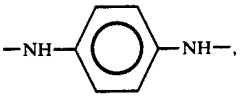

10 to 40 mole percent of

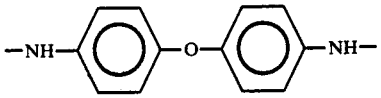

and 50 mole percent of

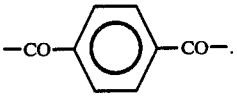

18. The reinforcing cord set forth in claim 12 wherein the glyceride is a triglyceride; the polyoxyethylene moiety has 5 to 50 ethylene groups and the acidic compound is selected from the group consisting of succinic, adipic, sebacic thiopropionic acids and anhydrides thereof.

* * * * *

UNITED STATES PATENT AND TRADEMARK OFFICE

CERTIFICATE OF CORRECTION

PATENT NO. : 4,670,343

DATED : June 2, 1987

INVENTOR(S) : Shoji Makino, Michikage Matsui and Shozaburo Hiratsuka

It is certified that error appears in the above-identified patent and that said Letters Patent is hereby corrected as shown below:

Column 2, line 50, change "mole is" to --mole, which is--;

Column 2, line 67, change "mole of" to --and 50% by mole of--;

Column 3, line 27, change "mole also is" to --mole, which also is--;

Column 3, line 60, change "oxide in" to --oxide groups in--;

Column 5, line 38, change "is" to --was--;

Column 5, line 42, change "power" to --powder--;

Column 6, lines 7 and 8, change ",CHARAC-TERIZED having" to --charac-terized by having--;

Column 9, line 13, change "80% mole percent" to --80 mole percent--;

Signed and Sealed this

Twenty-fourth Day of October, 1989

*Attest:*

DONALD J. QUIGG

*Attesting Officer*

*Commissioner of Patents and Trademarks*